United States Patent [19]

Alexander

[11] Patent Number: 5,067,621

[45] Date of Patent: Nov. 26, 1991

[54] MULTI-LEVEL SUSPENDED GARMENT HOLDER

[76] Inventor: Elmore Alexander, 5024-D Strawberry Hill Dr., Charlotte, N.C. 28211

[21] Appl. No.: 367,543

[22] Filed: Jun. 16, 1989

Related U.S. Application Data

[63] Continuation-in-part of Ser. No. 120,588, Nov. 13, 1987, abandoned.

[51] Int. Cl.[5] ..... A47F 5/00

[52] U.S. Cl. ..... 211/117; 248/320; 248/328

[58] Field of Search ..... 211/113, 117, 118, 209; 248/320, 328, 332

[56] References Cited

U.S. PATENT DOCUMENTS

| | | | |
|---|---|---|---|
| 108,818 | 11/1870 | O'Dell | 211/117 |
| 1,090,837 | 3/1914 | Clarke | 211/117 |
| 1,126,575 | 1/1915 | Schimanski | 211/117 |
| 1,250,626 | 12/1917 | Neef | 211/117 |
| 1,370,981 | 3/1921 | McGowan | 211/117 X |
| 4,057,211 | 11/1977 | Moore | 248/332 |
| 4,422,556 | 12/1983 | Moore | 211/117 X |

*Primary Examiner*—Robert W. Gibson, Jr.
*Attorney, Agent, or Firm*—Ralph H. Dougherty

[57] ABSTRACT

A garment holder especially suited for neckties, scarves, belts, etc., that loads or unload garments at a convenient height and stores the garments near the ceiling. The main garment hanging area utilizes a coil, wherein a torsion bar stabilizes and strengthens the coil by connecting the coil and torsion bar at said coil top and bottom. The tail stabilizer located at the bottom of the torsion bar provides a secondary hanging area and helps level and stabilize the garment holder. Multi-level action is attained because the hanging eye is connected to a ceiling mounted pulley by a rope which uses two handles to control the load and unload positions whereby a downward pull causes the ring hitches to a wing nut to separate allowing the rope to lower the garment holder until stopped by a washer resting against the pulley. Storage at ceiling level is attained from this position by pulling on the handles until the ring reengages the wing nut hitch. An optical high production garment hanger coil is made in two pieces; the coil and the insert. The insert snaps into the coil to provide all of the features of the original coil. The hanger can use three optional hoists; one uses an electric motor to wind the rope up and down on a spool for height variations; the other two utilize a locking pulley that responds to rope knots or similar protruders placed in or on the rope. The second uses an arrestor arm to capture and lock the rope in an "s" configuration, and releases the rope when the "s" configuration is removed. The third is a "Rail and Catch Pulley," which uses no external moving parts, but utilizes an upper and lower rail and a fork-like catch, to achieve locking and releasing of the garment holder.

13 Claims, 4 Drawing Sheets

MULTI-LEVEL SUSPENDED GARMENT HOLDER

CROSS REFERENCE TO RELATED APPLICATION

This application is a continuation-in-part of application Ser. No. 07/120,588, filed Nov. 13, 1987, now abandoned.

BACKGROUND

1. Field of the Invention

This invention relates to garment holders, especially to a new and improved coil shaped garment holder that self-levels, loads and unloads at convenient heights, and stores in the unused area under the ceiling. Heretofore, small garment hangers shared space with large garments in hanging areas. Acceptable spots were very limited. Aesthetics could not be appreciated because small garment hangers were usually sandwiched between large garments, covered up or jammed into an invisible area. In the past, these units seldom helped area organization because they didn't command frequent usage.

2. Description of Prior Art

The prior U.S. Pat. No. 4,057,211 issued Nov. 8, 1977, to Moore disclosed a locking pulley system wherein an arrestor arm was fixed relative to the housing of the pulley, and a swivel movement of the pulley by a release of tension in the cable caused the arrestor arm to move into the path of the link chain to engage one of the links and stop a weighted object from falling.

In U.S. Pat. No. 1,126,575 issued Jan. 26, 1915, inventor Schimanski disclosed a method of locking a clothes drier at variable heights without wall connections using a fixed rope catch that protruded down from the pulley system stopping near the grasp of the operator.

Prior art is very limited dealing with small garment holders and the problem of effective utilization of limited space. Specific emphasis is given to inventors Moore and Schimanski who disclosed a locking pulley system as part of their invention. Except for Kranefub who developed a system that covers clothes before they are pulled up in pits or mines, the inventors listed below used basically standard hoisting means.

| PATENT NUMBER | NAME | DATE |
|---|---|---|
| 108,818 | O'Dell | 11/01/1870 |
| 1,090,837 | Clarke | 03/24/1914 |
| 1,250,626 | Neef | 12/18/1917 |
| 1,370,981 | McGowan | 03/08/1921 |
| Nr. 231212 | Meltzer | 03/15/1944 |
| *G10267X/34f | Kranefub | 11/08/1952 |

Each of these patents failed to incorporate the uniqueness of using a coil shaped design to present a garment holder that possesses vast hanging area and strength for its overall size and weight. They also fail to provide for the present need for an economical locking pulley system to fully control the garment holder from various positions underneath, thereby eliminating unsightly wall hitches and permitting rapid access, programmable safety and unlimited placement of the unit away from side walls.

OBJECTS AND ADVANTAGES

The principal object of my invention is to provide a small garment holding device that is light in weight, reliable, and easily installed which can utilize the unused limited space in closets and other areas by allowing the user to load articles at a convenient height, and store them at another height near the ceiling.

It is another object of this invention to provide a garment holder whose size is small but possessed vast loading capacity and strength.

It is also another object of this invention to provide a small garment holding device that is easily accessible and aesthetically stimulating where as it compliments its surrounding area and encourages regular usage.

It is another object of this invention to provide a small garment holding device that is self-leveling, and which compensates for uneven loading through a tail stabilizer bar connected to a torsion bar.

SUMMARY OF THE INVENTION

A garment holder is made in two pieces to accommodate high production machines, and snapped together by the consumer thus reducing packaging and production cost. An optional electric hoist raises and lowers the garment holder when proper buttons are pressed. Two optional locking pulleys respond to protrusions such as knots or adjustable beads placed in or on the control hoisting rope to lock the garment holder at various heights. One pulley uses an arrestor arm that pivots in the pulley housing for locking, and the other has no outside moving parts wherein the specially designed rail and catch pulley accomplishes this purpose. These options give the garment holder quick response, placement flexibility, and programmable safety and height variations when in use.

Readers will find further objects and advantages of the invention from consideration of the ensuing description and accompanying drawings.

DETAILED DESCRIPTION OF INVENTION

Figure 1:
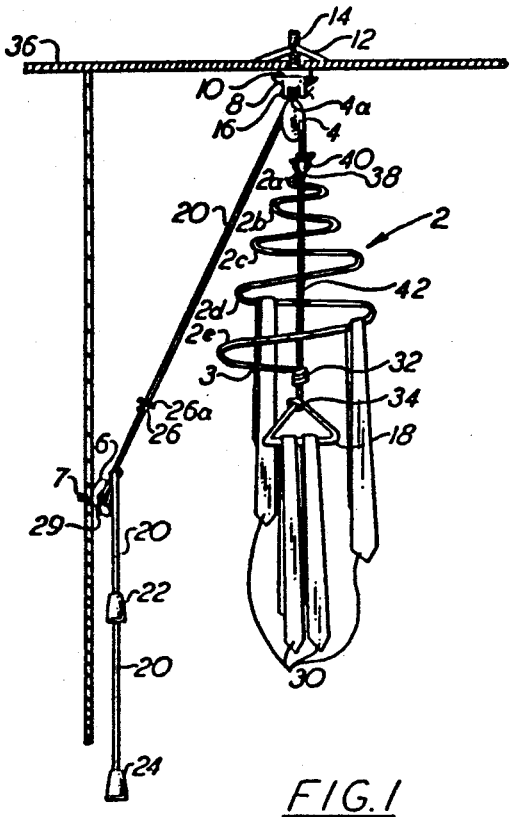
FIG. 1 is a perspective view of the invention in its upper storage position holding a few articles of clothing.
Figure 2:
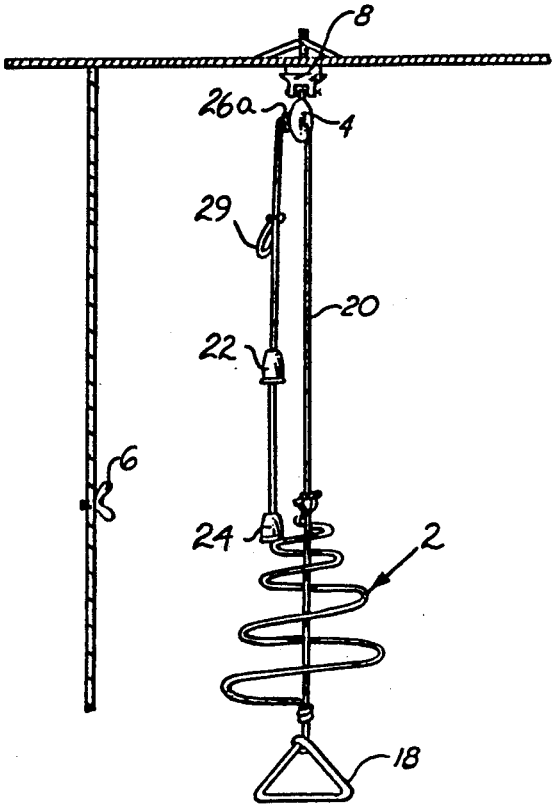
FIG. 2 is a perspective view of the invention in its lowered position, for loading and unloading.
Figure 3:
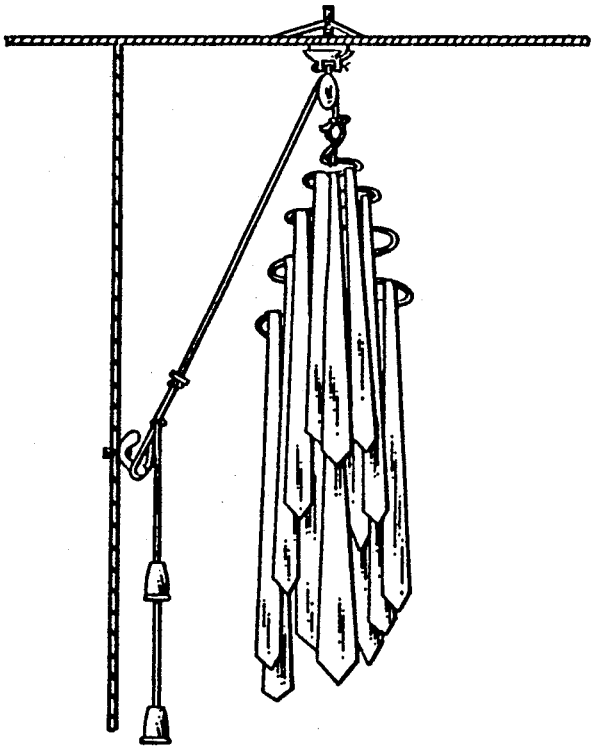
FIG. 3 is a perspective view of a loaded garment holder in its storage position using the layered hanging method of loading.

FIGS. 1, 2, and 3 show a multi-level garment holder in a typical installation according to the preferred embodiment of the invention.

Figure 5:
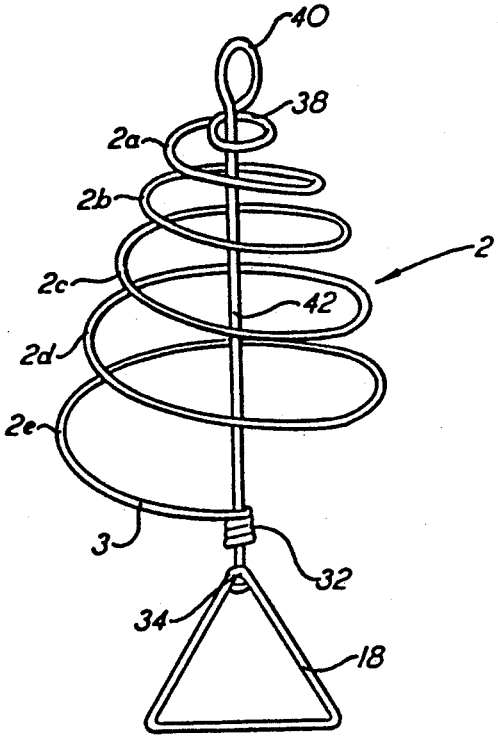
FIG. 5 is a front view of the garment holder with its torsion bar 42, tail stabilizer 18, and main hanging coil 2, comprising coil segments *2a* through *2e*, and coil brace 3.

FIG. 5 is a close-up view of a garment holder made from a single piece of measured uncut 12 gauge galvanized wire, preferably coated or painted. The garment holder comprises a tail stabilizer bar 18 triangular in shape, which is first formed and anchored by krimp tie 34 to a torsion bar 42 fashioned to extend lengthwise through the entire coil section 2*a* through 2*e*. The torsion bar 42 upper end forms a hanging eye 40 which is anchored by twist krimp 38, and continues to form the smallest of the coil loops, a coil 2*a* of the main hanging coil section 2, and the remaining proportionately larger loops 2*b* through 2*e*. Coil 2*e* upon completion is bent downward to form a coil brace 3, which is attached to the torsion bar 42 above the tail stabilizer 18, and the krimp tie 34, by krimp tie 32, thus completing the garment holder one piece uncut assembly.

Figure 4:
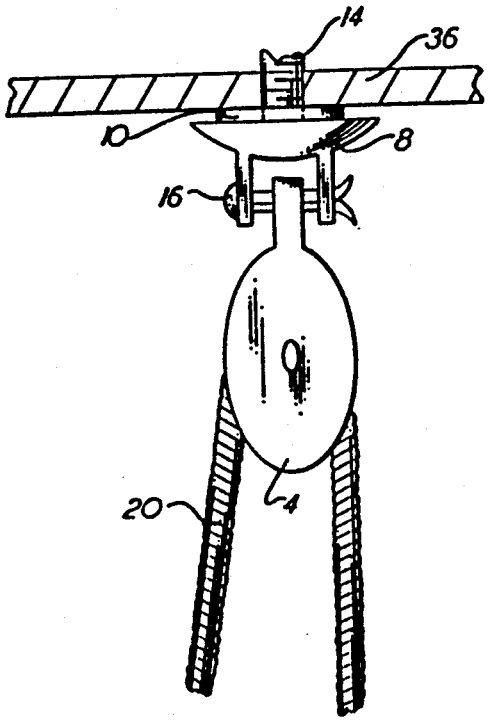
FIG. 4 is a side view through a ceiling showing a suspended pulley and modified ceiling hook with brad and butterfly anchor according to one embodiment of the invention.

The ceiling suspended pulley 4 is best seen in FIG. 4. A ceiling 36 supports a butterfly hook 12 which has a bolt 14 that passes through a ceiling hole 11 and a washer 10 to connect the ceiling hanger 8 to pulley 4, which is secured by a brad 16 that is positioned in holes (not shown) in the ceiling hanger 8 and the hanging eye 4*a* of the pulley 4.

Figure 6:
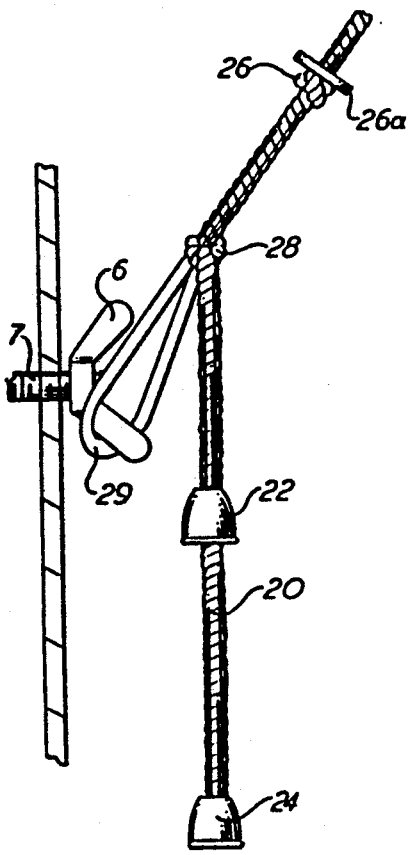
FIG. 6 shows a wing nut hitch.

The rope height control best seen in FIG. 6 comprises a rope 20 knotted (not shown) to support a handle 24 installed in the lower position, and handle 22 installed higher up and close to a ring 29 which is secured by the rope 20 which is fashioned to form a rope tie 28 and continuing, forms a knot 26 and supports the washer 26*a*, before passing over the ceiling suspended pulley 4, through pulley eye 4*a* and thus tied by a rope knot (not shown) to suspend the garment holder. Wing nut 6 hitches the ring 29 to lock the garment holder in the up position.

Rope 20 is preferably made from a heavy drape cord or light rope, and ring 29 and the handles 22 and 24 are plastic, while the wing nut is made of metal.

Figure 7:
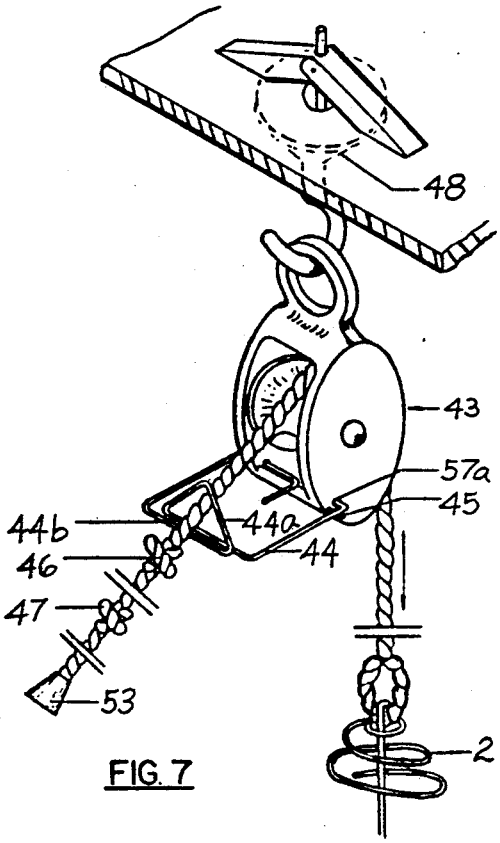
FIG. 7 is an isometric view of an arrestor arm of a locking pulley suspended from a ceiling hook.
Figure 8:
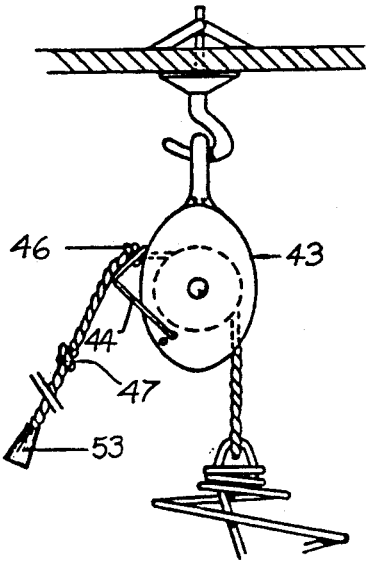
FIG. 8 is a side view of the locking pulley showing a protrusion such as a rope knot as it hits the striker bar causing the arrestor arm to trip and snag and lock the protrusion of the hoist rope in an "s" configuration.
Figure 9:
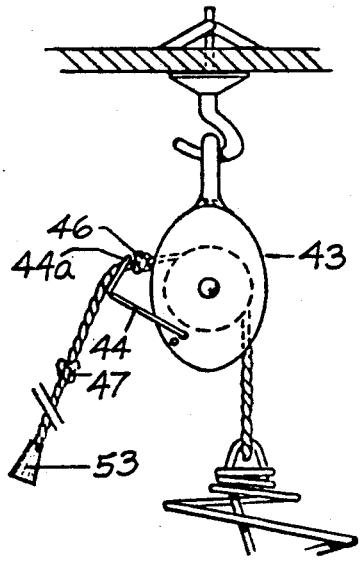
FIG. 9 is a side view of the locking pulley, showing the slip-through arrangement of the rope protrusion when the "s" shape of the rope is straightened out by a reverse tug on the control side of the rope.

FIG. 7 shows the optional manually operated locking pulley suspended from a ceiling hook in a typical installation, according to an optional embodiment of the invention. The typical pulley 43 is fitted with a wire arrestor arm 44 that pivots in the holes 57*a* and 57*b* in the housing of the pulley, and can rest against stop 45. The arrestor arm consists of a horizontal trip bar 44*b* and a triangle shaped capture triangle 44*a*. When lowering a weight such as a garment holder, the rope knots 46 and 47 contact the trip bar, which pivots the arrestor arm up, moves the capture triangle in position against the pulley wheel, passes over the trip bar, and is captured by the capture triangle, locking the rope in an "s" configuration near the captured knot, best seen in FIG. 8. Continued lowering is achieved by pulling slightly in reverse on the control side of the rope, which straightens out the "s" in the rope, and causes the knot to slip through the capture triangle, seat the arrestor arm against the stop, and allow the garment holder coil to be lowered until the next knot is sensed by the arrestor arm. During lifting the knot makes contact with the trip bar, but spring action allows it to pass freely through the arrestor arm, as best seen in FIG. 9.

Figure 11:
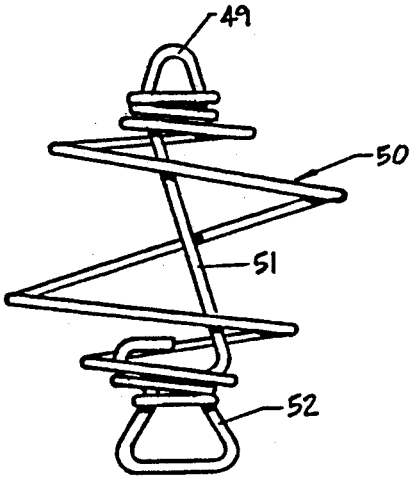
FIG. 11 is a front elevational view of a two piece garment holder wherein the coil is in one piece; and the hanging eye, torsion bar and tail stabilizer form the second piece which is snapped into place to form a whole unit.

FIG. 11 shows an optional high production machine-adaptable garment holder coil that's made in two pieces. Coil machines produce the coil 50 and four slide machines produce the insert 51 containing a hanging eye or suspension eye member 49, a torsion bar 51 and a stabilizer hanging bar 52, that passes through one end of the coil and anchors against the inside or tail stabilizer article hanging bracket member of the other end exposing the hanging eye, now permitting the opposite end of the insert to be snapped into place at its first point of entry into the coil.

Figure 10:
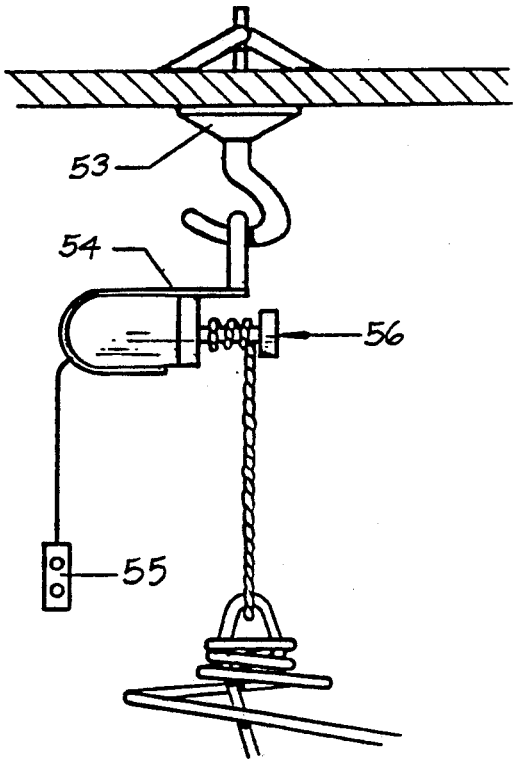
FIG. 10 is a side elevation of an electric hoist with control means for raising and lowering the garment holder.

FIG. 10 shows an optional electric motor hoist with control means wherein the shaft is connected to a spool-like pulley 56 that raises and lowers the garment holder.

Figure 12:
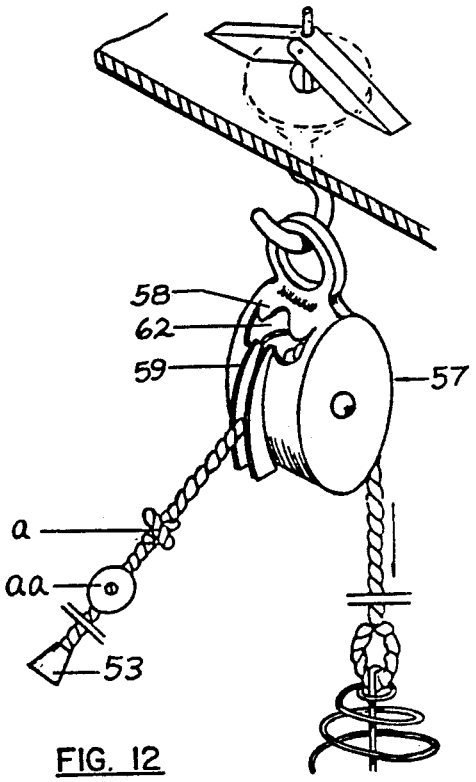
FIG. 12 is an isometric view of a rail and catch locking pulley.
Figure 13:
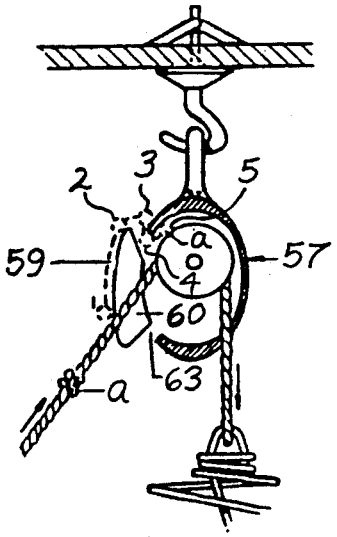
FIG. 13 is a partially cutaway view of a rail and catch locking pulley which shows the movement of the rope knot or protrusion when lowering and locking a weight in place.
Figure 14:
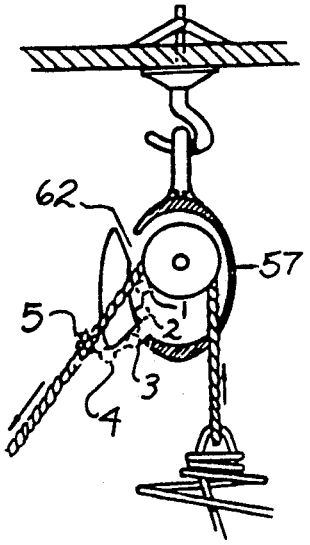
FIG. 14 is a partially cutaway view of a rail and catch locking pulley which shows the movement of the rope knot or similar protrusion when raising and locking a garment holder or weight in place.

FIGS. 12, 13, and 14 show a rail and catch locking pulley 57 which guides and engages retention means such as knots a or adjustable beads aa on a rope. When lowering the garment holder, the knots move along the spaced outer rails 59 with the rope positioned in the space between the rails. The speed of movement of the rope causes a knot to engage v-shaped catch 58. If it is desired to continue lowering the hanger, the rope is pulled slightly in reverse, and the knot drops out of the catch 58 and the rope continues to pass around the pulley.

FIG. 12 shows a "Rail and Catch," locking pulley, and its four main parts to achieve variable height locking control of the garment holder or weight when raising or lowering. The main parts are the dual outer rail 59, the inner rail 60, the catch 58, and the gap 62, which is shaped to accommodate a specific retention means. The control rope is fitted with a knot (a) or an adjustable bead (aa), which is placed at desired stop positions along the rope. Dual rails 59 guide the placed rope retainers up and onto the catch 58 which locks the suspended weight in place.

FIG. 13 is a partially cut-away sectional view which shows with dotted numerical lines the progression of a rope knot when lowering. It shows the progression from the first contact with the dual upper rails at 81, to the fall off at 82, and the catch and locking at 83; which establishes the first variable height lock. To lower to other heights, the locked protruding knot or bead is pulled off the catch 82 with a reverse pull on the rope, at which point the knot enters the gap 62 as indicated at 84, where a forward release of the rope moves it to a free fall position 85 which will continue until another knot engages the top rail 59, which will cause a repeat of the aforementioned sequence.

Raising the garment holder or weight can begin at any point. FIG. 14 is a partially cut-away sectional view of the rail and catch pulley which shows the progression of the rope knot. Pulling the rope in reverse causes the knot to leave the pulley wheel at 91, make contact with the back side dual rail 60 at 92, continue to follow the rail downward to 93, slide off the rail at 94, and pull free at 95. The weight will continue to raise freely until another rope knot engages the dual rear rail, whose function is to guide the knots through the pulley when raising the garment holder or weight.

Forward release will set into motion the locking process which will occur with the first contact of a knot or protrusion a against the dual top rails.

Unlimited stops can be established by adding more protrusions such as knots or beads at various locations.

OPERATION OF INVENTION

The multi-level suspended garment holder best seen in FIGS. 1, 2, and 3 will provide storage and easy access loading and unloading for a variety of small garments, including the self-leveling, organizational, aesthetic, multi-level quick access, and easy installation features of the unit.

Multi-Level Quick Access: Height variations are quickly achieved using a pulley 4 and a rope 20 connected to the garment holder, best seen in the storage position in FIG. 1, and in the load and unload position in FIG. 2.

The garment holder position in FIG. 1 is achieved by pulling down on the rope handles 24 and 22 of FIG. 2, which can swiftly raise the garment holder to the storage position as in FIG. 1, allowing ring 20 to be attached underneath a wing nut 6, to securely lock the garment holder in the elevated position.

The load and unload position in FIG. 2 is derived by releasing the ring 29, which is in position as in FIG. 1, from the wing nut 6, by pulling down on the handles 24 and 22, and allowing the garment holder to be lowered until stopped by washer 26*a* (as in FIG. 1) which is preset to hold the garment holder at a convenient height for loading and unloading.

Loading and Self-Leveling: FIGS. 1 and 3 show the garment holder accommodating a huge load of articles when compared to its size. Loading should start by first loading a tail stabilizer 18 with articles as best seen in FIG. 1, while keeping in mind that more weight in this area gives better stability and leveling for loading a main coil 2, which consists of coil segments 2*a* through 2*e*. The coil segments 2*a* through 2*e* should be loaded from the bottom, followed by around the coil segments and finally upward toward the top. Each level should be layered over the preceding, and should look similar to the loaded garment holder as in FIG. 3.

Easy Installation: The garment holder and the multi-level hoisting unit best seen in FIGS. 1, 2 and 3, is easily installed and requires no special tools. Hole 11 is drilled or pierced through a ceiling 36, and must be of sufficient size to permit the passage of a butterfly 12 and a screw 14, which passes through a washer 10, and is securely tightened into a ceiling hanger 8 as best seen in FIG. 1. The pulley 4 is then installed by passing a brad 16 through the slots in the ceiling hanger 8 and the pulley 4. Select a suitable length of cord or light rope and fasten it to the garment hanger by putting one end through a hanging eye 40 and securing it with a proper knot. Guide the other end over and through the pulley wheel of the pulley 4, and slide a washer 26*a* into position as shown in FIG. 1. Select a proper loading height for the garment holder by lowering it and putting a mark on the rope 20 at the back of pulley 4, and secure the washer 26*a* in place by putting a suitable knot 26 in the cord. The wing nut 6 is a hitch installed at a suitable height on a wall or door jam and anchored by a screw 7 as seen in FIG. 1. Securely tie the ring 29 in the rope 20 to allow the garment holder to rest within one half inch of its maximum height when hooked to the wing nut 6 in FIG. 1. Placing and anchoring the handles 24 and 22 on the rope 20 as best seen in FIG. 1, will allow full control of the weight of the garment holder from one position to the next and thus completes the installation, which normally takes from ten to fifteen minutes.

To raise the garment holder connected to the optional manually operated locking pulley of FIG. 7 to a storage position, pull down on the ball, until the desired height is reached and the rope knot, has cleared the arrestor arm. Allow the control rope to travel in reverse until the knot is captured. To lower the garment holder to an access position, grasp the ball and firmly and slowly pull back on the control line until a slight "snap" is felt as the arrestor arm straightens out the rope and slips past the captured knot. Immediately, allow the rope to move forward until it is again captured at the access position. Load height and safety stops can be programmed by adding or adjusting the position of the rope knots.

The optional electric hoist of FIG. 10 is operated by simply pressing the control buttons on the box 55, which winds the rope forward or reverse on to spool 56, causing variations in the height of the garment holder.

Operation of the "Rail and Catch" pulley in FIGS. 12, 13, and 14 will for all practical purposes feel the same as the locking pulley of FIG. 7, however, this pulley has no external moving parts. A backward pull on the control rope will release the locking action and allow free-fall lowering until a knot or similar placed protruder is sensed at the top rail and fork catch of the pulley housing. This will again cause locking of the garment holder at a different height. Raising can start at any point, by simply pulling back on the control rope. Once the desired height is reached the operator must allow the control rope to travel forward where locking will occur at the closest knot or protrusion. Thus placement of protruders on the control rope gives unlimited height and safety variations.

Other Qualities: Once the installation is complete, the user will appreciate other qualities because it becomes a focal point of its area, and provides organizational and aesthetic qualities that stimulate frequent usage.

Thus the reader will see the garment holder of the invention provides a highly reliable lightweight, yet economical device that can be used by persons of almost any age.

While my above description contains many specificities, these should not be misconstrued as limitations on the scope of the invention, but rather as an exemplification of one preferred embodiment thereof. Many other variations are possible. For example, skilled artisans will readily be able to change the dimensions and shapes of the various embodiments and use alternative materials such as plastic and wood. As an alternative, one can use a counter weight for the tail stabilizer, or the garment holder could be rescaled and holders or hangers added. The hoisting mechanism could assume many forms of pulley stop and start arrangements, such as used to raise and lower venetian blinds, which gives unlimited height variations of the garment holder by using the angle of the cord or rope to activate an arm or clamp for height control. The garment holder could be suspended from single level holders, or a spindle could be added for a carousel effect for easy access.

The garment holder could be mounted to store articles in the space above a lowered or false ceiling by providing an opening or door for the unit to pass through. A chain of racks could be constructed for high ceilings by using subsequent garment holders attached to its stabilizer bar for leveling. Accordingly, the reader is requested to determine the scope of the invention by the appended claims and their legal equivalents, and not by the examples which have been given.

I claim:

1. An improved garment holder for holding articles of clothing in a hanging position, comprising:

a coil member, a vertically oriented torsion bar member attached to and extending through said coil, a tail stabilizer article hanging bracket member attached to the bottom end of torsion bar, a suspension eye member fixed to the top of said torsion bar, ceiling hoist and suspension means for raising and lowering said garment holder, and means for fixing said garment holder at variable elevations.

2. The garment holder of claim 1 wherein said coil member is made of wire.

3. The garment holder of claim 1 wherein said coil member is made of plastic coated wire.

4. The garment holder of claim 1, further comprising retention means for fixing the elevation of said garment holder at one of at least two heights.

5. The garment holder of claim 1 wherein said coil member, said torsion bar, said tail stabilizer, and said suspension eye member are fabricated from a single piece of wire.

6. The garment holder of claim 1 wherein the ceiling hoisting suspension means is an electric motorized hoist with control means.

7. The garment holder of claim 1 wherein the ceiling hoist suspension means is a venetian blind type hoist.

8. The garment holder of claim 1 wherein the ceiling hoist means is a suspension rope, further comprising spindle means between said suspension eye member and said suspension rope.

9. The garment holder of claim 1 wherein said coil means and said torsion bar are separate pieces adapted for being snapped together to form the garment holder.

10. The garment holder of claim 8 further including a locking pulley, said suspension rope being provided with knots therein or protrusions thereon for engagement with said locking pulley.

11. The garment holder of claim 10 wherein said pulley has a housing, further comprising an arrestor arm pivotally mounted on said housing, said arrestor arm including means engageable by said rope knots or protrusions for locking and releasing the garment holder.

12. The garment holder of claim 11 wherein the locking and releasing means is a stationary fork hitch having upper and lower tracks incorporated into the pulley housing.

13. The garment holder of claim 11 wherein the locking and releasing means is a triangular member integral with said arrestor arm, and having an upwardly extending apex.

* * * * *